United States Patent [19]

Creedon

[11] Patent Number: 4,840,200

[45] Date of Patent: Jun. 20, 1989

[54] PRESTRESSED TUBE

[75] Inventor: Richard L. Creedon, San Diego, Calif.

[73] Assignee: General Atomics, San Diego, Calif.

[21] Appl. No.: 110,211

[22] Filed: Oct. 19, 1987

Related U.S. Application Data

[60] Division of Ser. No. 818,203, Jan. 13, 1986, Pat. No. 4,774,872, which is a continuation-in-part of Ser. No. 506,430, Jun. 21, 1983, Pat. No. 4,624,173.

[51] Int. Cl.[4] ..... F16L 9/04

[52] U.S. Cl. ..... 138/172; 138/153; 138/129; 138/176; 264/228; 264/231

[58] Field of Search ..... 138/124, 125, 126, 127, 138/130, 131, 103, 97, 93, 153, 172, 174, 175, 176, 177, 178, 129; 264/228, 231, 32; 89/8, 16

[56] References Cited

U.S. PATENT DOCUMENTS

| | | | |
|---|---|---|---|
| 1,776,468 | 9/1930 | Frank | 138/172 X |
| 1,965,748 | 7/1934 | Mitchell | 72/54 |
| 2,048,253 | 7/1936 | Freyssinet | 25/41 |
| 2,585,446 | 2/1952 | Edwin et al. | 264/94 |
| 2,683,915 | 7/1954 | Tournon | 25/154 |
| 2,709,845 | 6/1955 | Serkin | 25/154 |
| 3,056,183 | 10/1962 | Pigeot | 138/176 X |
| 3,107,158 | 10/1963 | Ahlberg | 264/228 |
| 3,202,740 | 8/1965 | Paten | 264/228 |
| 3,228,298 | 1/1966 | Grandy et al. | 89/16 |
| 3,249,665 | 5/1966 | Bearden et al. | 264/94 |
| 3,360,020 | 7/1966 | Patin | 52/2 |
| 3,462,521 | 8/1969 | Bini | 264/228 |
| 3,489,626 | 1/1970 | Rubenstein | 204/228 |
| 3,532,123 | 10/1970 | Rubenstein | 138/172 |
| 3,567,816 | 3/1971 | Embree | 264/228 |
| 3,604,732 | 9/1971 | Malone | 138/93 |
| 3,742,985 | 7/1973 | Rubenstein | 138/176 |
| 4,424,734 | 1/1984 | Janssen et al. | 89/16 |
| 4,427,033 | 1/1984 | Ege | 138/174 |
| 4,529,567 | 7/1985 | Richard | 264/228 |

FOREIGN PATENT DOCUMENTS

| | | |
|---|---|---|
| 222557 | 7/1962 | Austria . |
| 741460 | 4/1970 | Belgium . |
| 2710011 | 9/1978 | Fed. Rep. of Germany . |
| 179238 | 5/1962 | Sweden . |

*Primary Examiner*—James E. Bryant, III

*Attorney, Agent, or Firm*—Fitch, Even, Tabin & Flannery

[57] ABSTRACT

Disclosed is a prestressed tube and a method of its manufacture. The tube includes inner and outer walls with an intermediate nonadhering lamina layer. A pressure medium is fluidically injected through one of the walls to the interface between the nonadhering lamina layer and at least one of the walls so as to form a cavity therebetween for receiving the pressure medium. The medium is thereafter hardened to provide a prestress force to the tube. The method includes the step of fluidically injecting pressure medium between the walls to the intermediate lamina layer and the interface between that layer and at least one of the walls, so as to form a gap therebetween for receiving the pressure medium. During the step, one or both of the walls may be expanded so as to form an enlarged cavity for receiving the pressure medium. The method thereafter includes the step of hardening the pressure medium so as to provide a permanent leak-proof prestress force to the tube.

12 Claims, 2 Drawing Sheets

FIG. 5
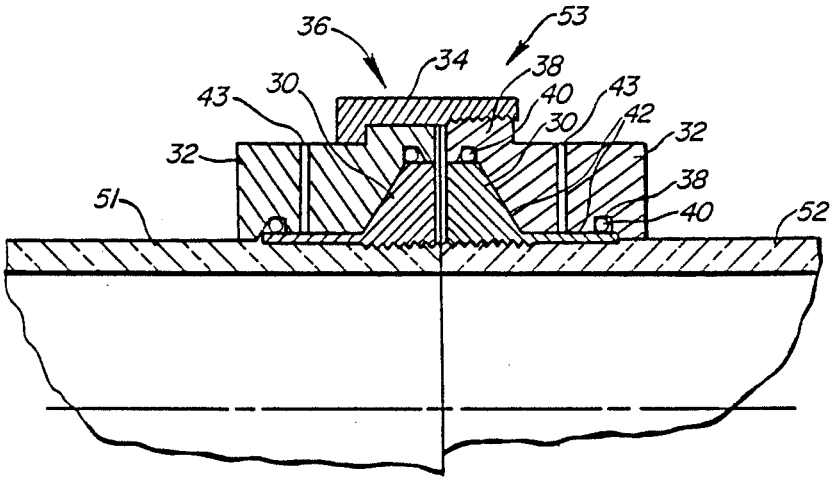
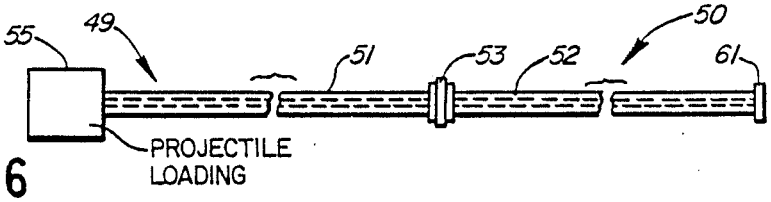
FIG. 6
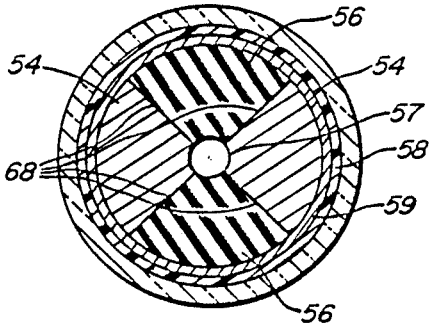
FIG. 7

PRESTRESSED TUBE

This application is a division of U.S. Ser. No. 818,203, filed Jan. 13, 1986, now U.S. Pat. No. 4,774,872, which is a continuation-in-part of Ser. No. 506,430 filed June 21, 1983 U.S. Pat. No. 4,624,173.

This invention relates to prestressed tubes and methods of their manufacture and especially to such prestressed tubes of unitary construction without reinforcing members such as steel tendons.

BACKGROUND OF THE INVENTION

A need exists for lightweight tubes capable of withstanding large bursting forces. One of the possible uses of such tubes is for rail gun barrels.

In a rail gun, it is desirable that the rails and the adjacent insulating members fit together with very close tolerances and be tightly constrained against displacement outward. A typical, known rail gun barrel assembly employs a large number of bolts to clamp stiff structural members about the barrel components to react bursting forces. Stronger, less cumbersome barrel designs are still being sought, and in other fields of endeavor, there is a demand for lightweight, inexpensive tubes which can successfully contain elevated pressures.

Another area in which a market demand exists for economically-constructed prestressed tubes is that of concrete pipes used for carrying water and other fluids under pressure. Concrete tubes and the like articles can be prestressed either during setting of the concrete or after the concrete has set or hardened.

Further, when the concrete articles are constructed in a tubular form, prestress forces may be applied either from within or without the concrete tube. Examples of prestress forces being applied to the inner bore of a concrete cylinder are given in U.S. Pat. Nos. 2,585,446; 2,709,845; and 3,249,665.

As mentioned, prestress forces may also be applied to the outside of the concrete article. For example, U.S. Pat. No. 2,048,253 disposes the concrete article within metal pressure-retaining plates and forces pressurized water between the metal plates and concrete article to apply a prestressing force. Further, concrete articles may be prestressed by applying or imparting prestress forces to reinforcing members (tendons) typically formed of high tensile strength steel disposed within the concrete articles. The reinforcing members, in turn, impart a prestress to the concrete material. Examples of this type of prestressing are given in the following U.S. Patents: U.S. Pat. Nos. 1,965,748; 2,683,915; 3,260,020; 3,202,740; and 3,567,816.

SUMMARY OF THE INVENTION

Accordingly, it is an object of the present invention to provide prestressed tubes and in particular prestressed tubes free of internal stress-imparting members, such as steel tendons, plates, ribs or the like.

Another object of the present invention is to provide a prestressed tube which is lightweight, is economically manufactured, and provides a continuous containment of bursting pressures, either static or dynamic, disposed within the tube.

Yet another object of the present invention is to provide a prestressed tube having an internal prestressed medium which, when the tube is fully fabricated, is not fluid, so as to be susceptible to leaking or escaping from the tube.

These and other objects of the present invention are provided in a prestressed tube comprising inner and outer concentric, generally cylindrical walls which are substantially homogeneous and free of internal stress-imparting members. A nonadhering lamina is disposed between the inner and outer walls and a pressure medium is disposed between the nonadhering lamina and at least one of the inner and outer walls, so as to bias those walls away from each other with a prestressed force.

Other objects of the present invention are provided by a prestressed tube comprising inner and outer generally cylindrical walls, with the outer wall concentrically disposed about the inner wall. A nonadhering lamina layer is disposed between the inner and outer walls and an inlet means for injecting a pressure medium through at least one of the inside and outside walls, is disposed adjacent the lamina layer. A pressure medium fluidically injected through the inlet means and penetrating between the lamina and at least one of the inner and outer walls forms a medium-receiving cavity therebetween, and thereafter hardens to form a prestressing pressure force between the inner and outer walls.

Other objects of the present invention are provided in a method of making a prestressed tube comprising the steps of providing an inner and an outer generally cylindrical wall, and concentrically disposing the outer wall about the inner wall. The method further includes disposing a nonadhering lamina between the inner and outer walls and providing inlet means for injecting a pressure medium through at least one of the inner and outer walls to a point adjacent the lamina layer. The method further includes the step of fluidically injecting a pressure medium through the inlet means so as to penetrate between the nonadhering lamina layer and at least one of the inner and outer walls so as to form a medium-receiving cavity therebetween and thereafter hardening the pressure medium so as to provide a prestressing force between the inner and outer walls.

BRIEF DESCRIPTION OF THE DRAWINGS

In the drawings, in which like elements are referenced alike,

FIG. 5 is a partial sectional view of the two prestressed tube sections joined together;

FIG. 6 is a diagrammatic side elevational view of a rail gun barrel assembly using prestressed tubes constructed in accordance with one embodiment of the present invention; and FIG. 7 is a transverse cross-sectional view of a rail gun barrel assembly using prestressed tubes constructed in accordance with other aspects of the present invention.

DESCRIPTION OF THE PREFERRED EMBODIMENTS

Figure 1:
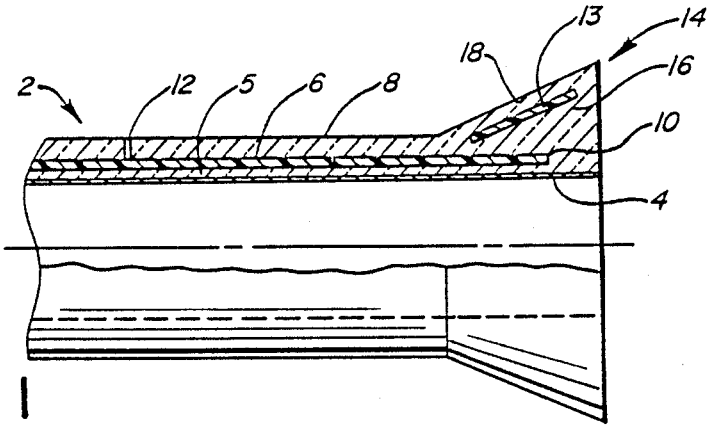
FIG. 1 is a fragmentary elevational view of one embodiment of a prestressed tube partially broken away and showing features the present invention.

Referring now to the drawings, one end of a filament wound prestressed tube 2 is shown in FIG. 1, with the top half illustrated in section. The filaments are wound on a thin-walled inner shell 4 having an outer radius of about 2 cm. Layers of filaments of glass at a 70% packing density in an epoxy matrix form an inner filament layer 5 having a thickness of about 3 mm. A nonadhering lamina 6 comprising a synthetic resin polymer such as Teflon, or a waxed paper is laid over the inner layer 5 and additional layers of filaments of glass, as described above, are wound over the nonadhering lamina to form an outer filament layer 8. The nonadhering lamina 6 extends to a point 10 approximately 2 cm short of the ends of the tube so that the nonadhering lamina layer 6 is completely enclosed by the inner filament layer 5 and the outer filament layer 8.

A small diameter hole 12 is drilled in the main body of the tube to the nonadhering lamina. Resin is injected under pressure which causes an annular split to develop along the lamina 6 to create an lamina space 7, and the pressure crushes inner filament layer 5 against inner shell 4. The resin may be injected on either the inside or outside or both sides of lamina 6. The pressure prestresses the tube to constrain it against bursting pressures. The resin is then cured. It is important to use a resin which does not appreciably decrease in volume when it is cured to the solid phase. For example, a 1% shrinkage could normally be tolerated and, in some cases, resins which shrink as much as 5% could be used. It is desirable to install a temporary reinforcement around the end of the tube during injection to prevent splitting at the end 10 of the lamina 6. This reinforcement can be removed when the resin has set. After the resin has set, removal of the reinforcement will cause the tube to split for an extremely short distance; but the resin, being in solid form, would not be able to move into the newly split portion to propagate the split further.

Figure 2:
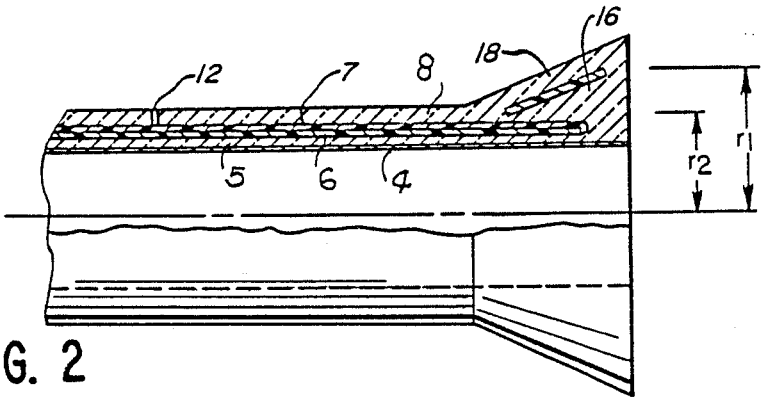
FIG. 2 is a fragmentary elevational view of another embodiment of a prestressed tube partially broken away and showing additional features of the present invention.

The tubes of FIGS. 1 and 2 is designed so that two sections of the tube may be joined together, if desired. Beginning at about three centimeters from the end to be joined, the outer layers of filament are built up to a flare 14 in which the inner diameter of the tube is uniform, while the outer diameter increases toward the end of the tube. However, a nonadhering lamina 13 is laid down between an inner flare 16 and an outer flare 18 in the same manner as described above. As shown in FIGS. 1 and 2, the lamina 13 is generally frustoconical or shaped like a flared annulus with the inside radius $r_1$ of the layer near the end of the tube being greater than the inside radius $r_2$ of the layer further from the end.

Figure 3:
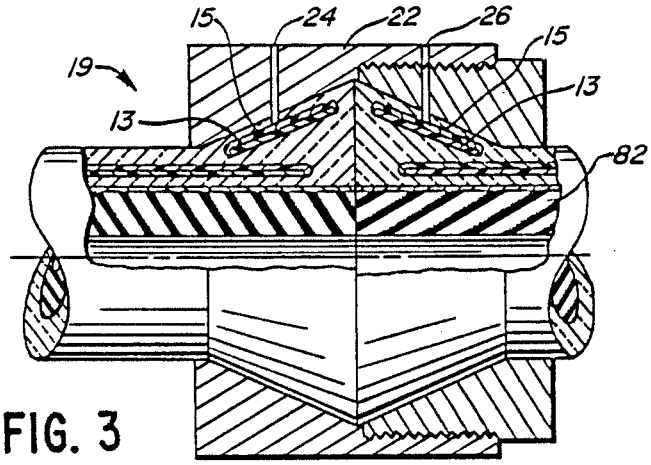
FIG. 3 is an elevational view of two prestressed tubes joined together.

FIG. 3 shows a joint of two tube sections constructed as described above. A sleeve assembly 19 is fitted over the flared ends of the two sections to be joined. In this embodiment the sleeve assembly consists of an inner sleeve element 20 and sleeve nut 22. Elements 20 and 22 comprise wrench grips so that they can be torqued together to compress the faces of the tube section together with an appropriate force in the range of a few hundred psi.

Small diameter holes 24 and 26 are drilled through the sleeve assembly into the flared portions of the tube sections so as to extend to the lamina 13 of those sections. As described above, pressure in the form of resin is applied at lamina 13 of each tube section, on either or both sides thereof, to cause a split along the lamina surfaces to create pressurized lamina spaces 15 along the lamina layers 13 which prestresses the end portions of the tube sections. The pressure in the lamina space also increases the pressure of the end faces of both sections against each other. Since the lamina space is at an angle in this embodiment of about 30° with the tube axis, the axial component of the force in the lamina is about 50% of the primary force. Similarly, the radial component is about 86% of the primary force. In this preferred embodiment, it has been determined that pressurization of the lamina space with approximately 5,000 psi can provide more than enough compressive pressure on the faces of the two sections.

Preferably, the lamina space should be designed to impose the proper forces axially, to compress the two ends together, and radially, to resist the radial bursting forces. By increasing the angle between the tube axis and a line joining the end points of the frustoconical lamina space 15, a greater portion of the pressure exerted by the pressure medium in the lamina space 15 will go to compressing the two sections together.

Figure 4:
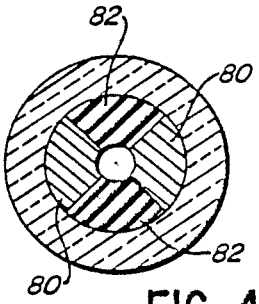
FIG. 4 is a transverse cross-sectional view of the prestressed tube of FIG. 3.

Referring now to FIG. 4, the embodiment described above is particularly suitable for use in the construction of long lightweight rail gun barrels. For such use, the above-described thin-walled inner shell 4 would be shrink-fitted around two rails 80 and the two insulator members 82 illustrated in FIG. 4, prior to winding the filament layers. For this application, the inner shell 4 preferably comprises a relatively flexible sleeve.

In one preferred embodiment, the inner shell 4 in FIG. 1 is replaced by a mandrel which is removed and replaced with the rails 54 and insulator members 56 prior to pressurizing the lamina space. In this embodiment, the inner filament layer 5 is collapsed against rails 54 and insulator members 56. Further details concerning the construction and operation of the rail gun, and the nature of the bursting forces encountered during operation thereof, are given below.

FIG. 5 illustrates another joinder or tube section wherein pistons 30 are screwed onto ends of tubular barrel sections 51 and 52 to simulate flared ends used in joining the tube sections. Sleeve element 32 and sleeve nut 34 are screwed together to form sleeve assembly 36 which compresses the two barrel ends together. "O" ring slots 38 in sleeve element 32 provide a space for rubber "O" rings 40. These "O" rings form the boundary for pressure cavity 42. As in the first embodiment, small diameter holes 43 are drilled in sleeve element 32 through which pressure cavity 42 is filled with a pressure medium to stress the components of the joint in both the axial direction to hold the ends together under compression and in the radial direction to counteract the radial bursting forces in the tube.

Referring to FIGS. 6 and 7, there is shown a rail gun assembly 49 comprising a barrel 50 comprised of two sections 51 and 52 joined by joint 53. Sections 51 and 52 each include a pair of elongated, generally parallel, insulating members 56 disposed between the rails 54.

The rails 54 are disposed symmetrically about the longitudinal axis of the barrel, as are the insulating members 56. The rails 54 may be made of a copper alloy or other conducting material and are electrically connected at their respective rearward or breech ends to opposite terminals of a source of direct current (not shown). Means 55 for loading projectiles into the barrel are provided at the breech end. The rails may have longitudinal passages (not shown) formed in them for coolant flow.

The rails 54 and insulating members 56 herein define a generally cylindrical bore 57 through which the projectile (not shown) travels. The bore 57 may be of circular cross section, as shown, or may alternatively be of rectangular or other suitable cross section.

A circuit through the rails may be completed either by a conductor or a plasma arc disposed between the rails. Where a plasma arc is used, high fluid pressures are generated within the barrel by the arc heating the plasma material. This material is initially in the form of a fuse on the projectile rear end. As current flows through the circuit, magnetic flux is generated between the rails. The magnetic flux cooperates with the current in the conductor or plasma arc to accelerate the conductor or plasma forward between the rails. The projectile may include the conductor or may be positioned forward of the conductor or plasma arc and driven forward thereby. The rails 54 are constrained against radially outward displacement and are preloaded by a pressure medium in pressure cavity 58. An inner shell 59, a lightweight, relatively rigid outer shell 60, and end sealing means 61 contain the pressure medium. The pressure medium in pressure cavity 58 applies approximately uniform radial compression forces to the peripheral surfaces of the rails 54 and insulating member 56, respectively, and applies relatively evenly distributed radial stresses to the outer shell 60. The pressure medium is pressurized prior to firing of the gun.

As stated above, high fluid pressure or gas pressure may be generated within the bore during firing due to the plasma arc. This pressure, in combination with the electromagnetic forces generated on the rails during firing, tends to push the rails 54 and insulating members 56 apart. If the rails and insulating members are constrained adequately, the stressed experienced by the inner portions of the rails 54 and insulating members 56 adjacent the bore are distributed over relatively large peripheral surfaces and transmitted to the outer shell 60. If the rails and insulating members move outward during firing, high pressure gases within the bore may leak through the interfaces 68 between the rails 54 and insulating members 56, and cause the outer shell 60 to burst. In accordance with the present invention, the pressure medium in a pressure cavity 58 supplies preload to the rails and insulating members sufficient to effectively seal the interfaces 68 from high pressure gas.

The pressure medium may be a fluid such as air, water or oil, or in the alternative may be a resin which is pressurized as a liquid and subsequently cured. When this invention is used to hold in place rail gun components, inner shell 59 should be a relatively flexible sleeve or membrane which fits over the rails 54 and insulating member 56 to prevent the pressure medium 58 from leaking into the interfaces 68 between the rails 54 and insulating members 56. Any suitable external pressurizing means (not shown) may be employed to bring the pressure medium to the desired pressure.

Where the pressure medium 58 is a gas or a fluid such as water or oil, it is maintained at a desired pressure during firing of the gun, but may be subsequently permitted to return to a lower pressure. Where the pressure medium is a resin, the resin is cured prior to use of the barrel 50 to set it at a predetermined pressure.

Use of a fluid such as a gas, water or oil facilitates removal of the rails 54 for maintenance in that it enables the pressure on the rails to be removed simply by reducing the pressure in the fluid. Use of a resin, on the other hand, provides a different advantage in that once the resin is cured, maintenance of pressure no longer requires maintenance of seals about the pressure medium in cavity 58. This may simplify assembly of the barrel and may permit the use of barrel configurations which would not be feasible with a fluid such as oil or water.

For purposes of clarity of illustration, the cross-sectional area of the pressure cavity 58 is disproportionately illustrated in the drawings. It may actually be a layer having a relative thickness much less than that shown. The thickness of this layer may be, for example, on the order of 0.5 mm.

The outer shell 60 is preferably made of a nonmetallic material. For example, it may be composed of woven silicon carbide fibers disposed within a resin, or may be composed of a glass composite material.

As can now be seen, the present invention provides prestressed tubes assembled to form an integral construction without requiring internal stress-imparting members, such as pretensioned or post-tensioned steel tendons, external casings, or the like pressure-retaining apparatus.

While the preferred embodiments have been illustrated and described herein, there is no intent to limit the scope of the invention to those or any other particular embodiment.

What is claimed is:

1. A prestressed tube comprising:

inner and outer concentric, generally cylindrical walls substantially homogeneous so as to be free of internal stress-imparting members and having opposed cylindrical surfaces;

a nonadhering lamina between said inner and said outer walls; and a pressure medium beween said nonadhering lamina and at least one of said inner and said outer walls, pressing agains the opposed cylindrical surfaces so as to bias said inner and said outer walls away from each other with a prestress force.

2. The prestressed tube of claim 1 wherein said said inner wall comprises a filament-wound tube including filaments in a resin matrix.

3. The prestressed tube of claim 2 wherein said filaments comprise glass fibers packed in an epoxy matrix with at least a 70% packing density.

4. The prestressed tube of claim 1 wherein said nonadhering lamina comprises a film of synthetic resin polymer.

5. The prestressed tube of claim 1 wherein said nonadhering lamina comprises waxed paper.

6. The prestressed tube of claim 1 wherein said pressure medium is disposed between said nonadhering lamina and said inner wall.

7. The prestressed tube of claim 1 wherein said pressure medium is disposed between said nonadhering lamina layer and said outer wall.

8. The prestressed tube of claim 1 wherein said pressure medium is disposed between said nonadhering lamina layer and both said inner and said outer walls.

9. A prestressed tube comprising:

an inner generally cylindrical wall substantially homogeneous so as to be free of internal stress-imparting members;

an outer generally cylindrical wall substantially homogeneous so as to be free of internal stres-imparting members concentrically disposed about said inner wall with outer and inner cylindrical surfaces of the inner and outer walls opposing one another, respectively;

a nonadhering lamina layer between said inner and said outer walls;

inlet means for injecting a pressure medium through at least one of said inside and said outside walls to said lamina layer; and a pressure medium fluidically injected through said inlet means penetrating between said lamina and at least one of said inner and said outer walls and forming a pressure medium-receiving cavity therebetween, said pressure medium thereafter hardening to form a prestressing pressure force pressing against the cylindrical surfaces so as to bias said inner and said outer walls away from each other.

10. The prestressed tube of claim 9 wherein said pressure medium is disposed between said nonadhering lamina and said inner wall.

11. The prestressed tube of claim 9 wherein said pressure medium is disposed between said nonadhering lamina layer and said outer wall.

12. The prestressed tube of claim 9 wherein said pressure medium is disposed between said nonadhering lamina layer and both said inner and said outer walls.

* * * * *

UNITED STATES PATENT AND TRADEMARK OFFICE

CERTIFICATE OF CORRECTION

PATENT NO. : 4,840,200

DATED : June 20, 1989

INVENTOR(S) : Richard Lewis Creedon

It is certified that error appears in the above-identified patent and that said Letters Patent is hereby corrected as shown below:

IN THE SPECIFICATION:

Column 5, line 37, delete the word "stressed" and insert in its stead the word --stresses--.

IN THE CLAIMS:

Column 6, line 36, delete the word "beween" and insert in its stead the word --between--.

Column 6, line 38, delete the word "agains" and insert in its stead the word --against--.

Column 6, line 66, delete the word "stres" and insert in its stead the word --stress--.

Signed and Sealed this

Tenth Day of April, 1990

*Attest:*

HARRY F. MANBECK, JR.

*Attesting Officer*

*Commissioner of Patents and Trademarks*